United States Patent [19]

Bitterlich

[11] 4,009,989

[45] Mar. 1, 1977

[54] COMBINATION GAS AND OIL BURNERS

[75] Inventor: Gordon M. Bitterlich, Tredyffrin Township, Chester County, Pa.

[73] Assignee: National Airoil Burner Company, Inc., Philadelphia, Pa.

[22] Filed: Mar. 11, 1976

[21] Appl. No.: 665,888

[52] U.S. Cl. ..... 431/178; 431/175

[51] Int. Cl.[2] ..... F23C 5/20

[58] Field of Search ..... 431/175, 177, 178, 179, 431/180, 278, 285, 348

[56] References Cited

UNITED STATES PATENTS

| | | | |
|---|---|---|---|
| 2,099,275 | 11/1937 | Nemec | 431/179 |
| 2,136,449 | 11/1938 | Loeffler | 431/179 |
| 2,659,424 | 11/1953 | Ferguson | 431/178 |
| 3,425,781 | 2/1969 | Bitterlich | 431/178 |

*Primary Examiner*—Carroll B. Dority, Jr.
*Attorney, Agent, or Firm*—Z. T. Wobensmith, 2nd; Z. T. Wobensmith, III

[57] ABSTRACT

A combination gas and oil burner is disclosed for heating a radiant wall in a reforming furnace for petroleum refinery processes or the like to provide heat for radiation by the wall and in which oil, gas, or both fuels, may be employed, the burners being readily removable for inspection and maintenance, and in which operation can be effected with one fuel with the apparatus for the other fuel being removed without shutting down the operation, and with greater stability attained by surrounding the flame passageways with refractory faces.

11 Claims, 4 Drawing Figures

COMBINATION GAS AND OIL BURNERS

BACKGROUND OF THE INVENTION

1. Field of the Invention

This invention relates to combination oil and gas burners for heating a radiant wall in a furnace.

2. Description of the Prior Art

In U.S. Pat. No. 2,659,424, to William Ferguson, a gas burner unit is shown for heating a radiant wall but the burner structure there shown had limitations on the total fuel input at each burner and no provisions were made for combination or alternative fuel burners.

In my prior U.S. Pat. No. 3,425,781, a combination burner is shown which was an improvement over the structure of the Ferguson patent noted above.

The flame stability in my prior patent and heating of the wall, while acceptable, did not provide as great flame stability or as high an order of uniformity of heating as desired.

The U.S. Pat. No. 3,915,621 to Donald J. Iverson, shows a burner for heaters wherein multiple fuel burners are provided, the burners being removable. The disposition of the gas burners and of the oil burner does not provide stabilized combustion nor uniformity of heating of the wall.

SUMMARY OF THE INVENTION

In accordance with the invention a combination gas and oil burner construction is shown for heating a radiant wall in a furnace for petroleum refinery processes or the like in which the fuels may be used separately or together, in which either the oil burners or gas burners may be removed if desired without interfering with continuous operation of the furnace, with provisions for obtaining with both the oil and gas burners better flame stability and flame distribution than heretofore and with a higher order of uniformity of heating of the wall, this being attendant on the air and flame passageways for the burners.

It is the principal object of the invention to provide burners for heating furnace walls which permit of high fuel input and control of the air for combustion utilizing oil and combustible gas, alone or together, and which has an improved flame stability and greater uniformity of wall heating.

It is a further object of the invention to provide a combination oil and gas burner of the character aforesaid which is effective in the event of a shortage of either fuel, and particularly gas.

It is a further object of the invention to provide burners for heating furnace walls of the character aforesaid in which either the oil burner or gas burners can be removed for inspection and maintenance, if desired, without interrupting the furnace operation.

It is a further object of the invention to provide combination oil and gas burners for heating furnace walls in which a burner block construction is employed which provides improved flame stability with both fuels as well as greater uniformity of wall heating.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part thereof, in which.

Figure 1:
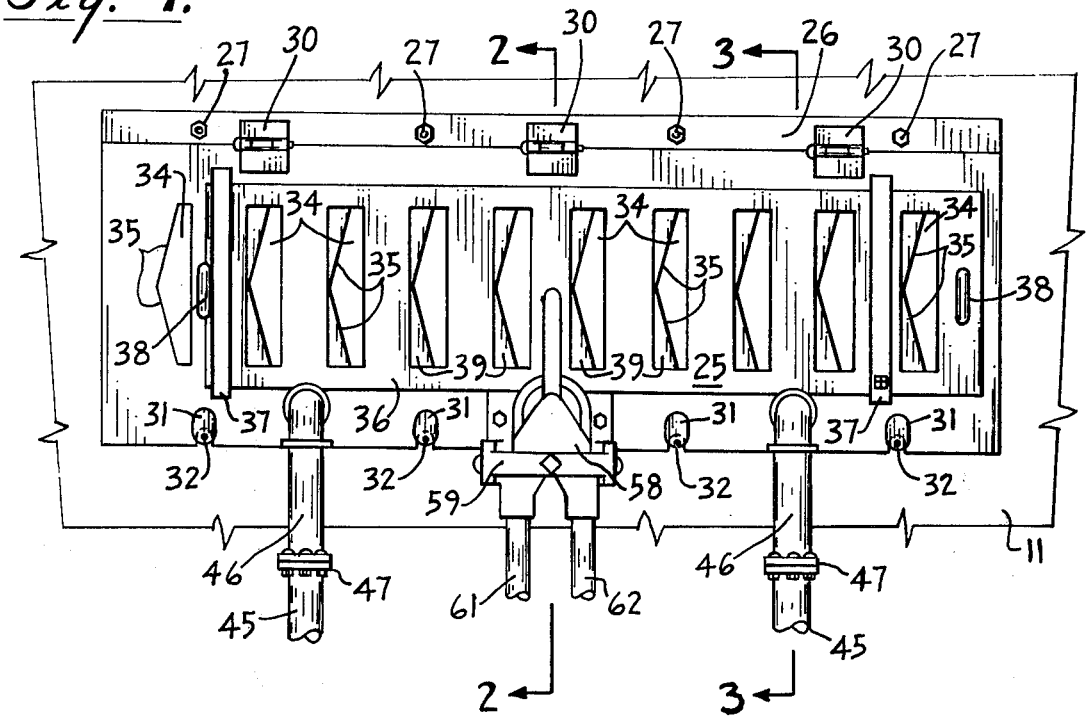
FIG. 1 is a fragmentary front elevational view of a portion of a vertical wall of a furnace having the combination oil and gas burner of the invention mounted thereon.
Figure 2:
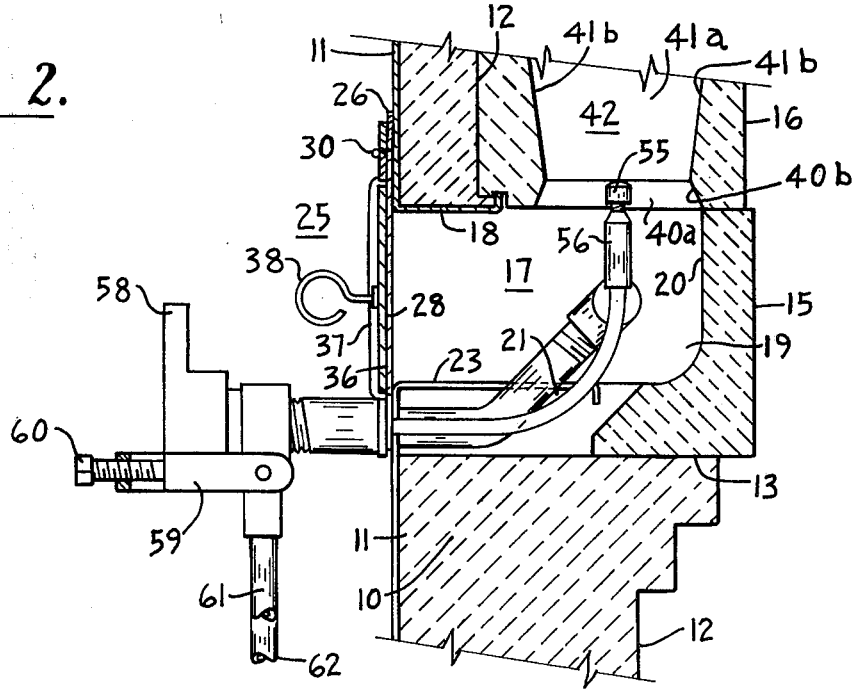
FIG. 2 is a vertical sectional view taken approximately on the line 2—2 of FIG. 1.
Figure 4:
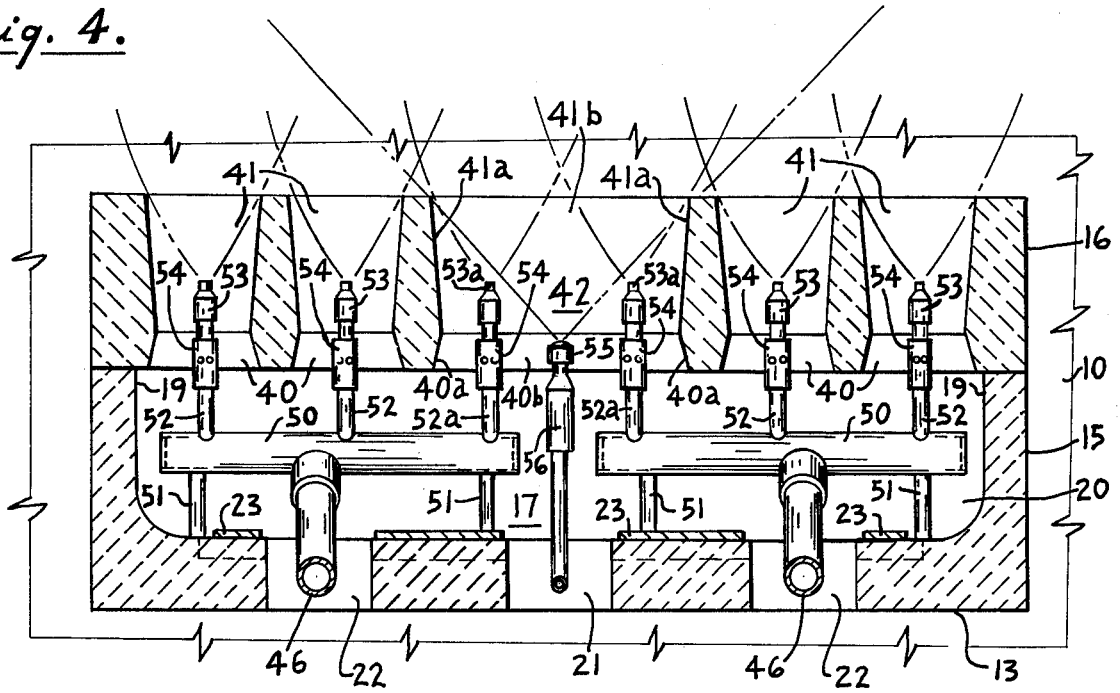
FIG. 4 is a vertical sectional view taken approximately on the line 4—4 of FIG. 3.
Figure 3:
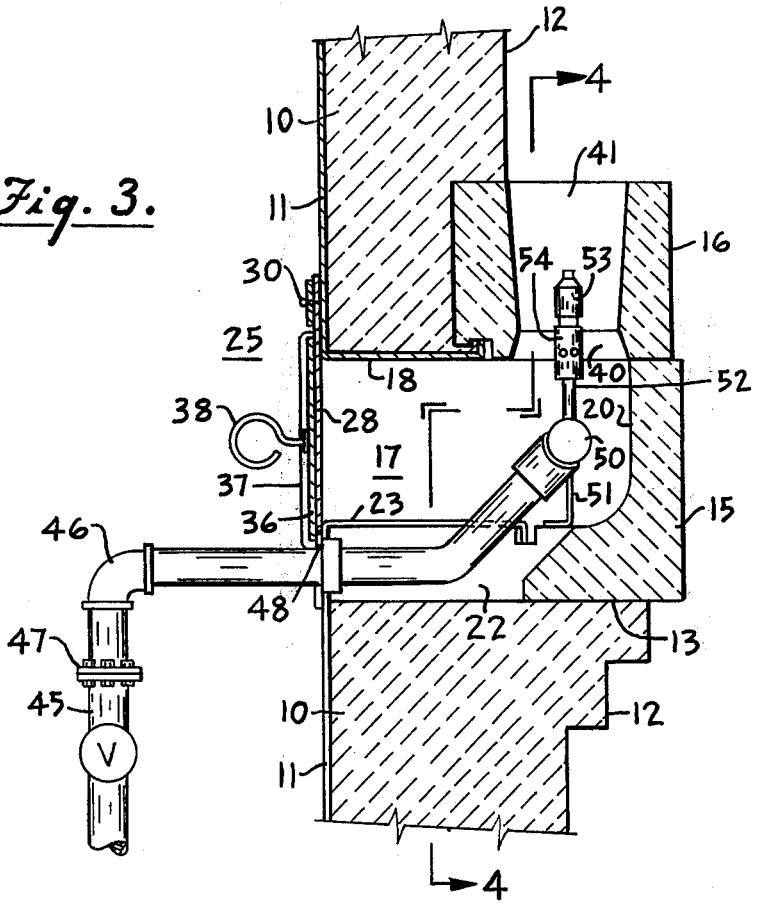
FIG. 3 is a vertical sectional view taken approximately on the line 3—3 of FIG. 1.

It should, of course, be understood that the description and drawings herein are illustrative merely, and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings, a fragmentary portion of a furnace is illustrated which includes a vertical wall 10 of ceramic refractory material, which may be the side or rear wall or the center wall of an up-draft heater or furnace of conventional type having an outer metal facing or cover 11.

At spaced locations along the wall 10 a burner block assembly is provided which includes a lower block 15 and an upper block 16 both of ceramic refractory material.

The lower block 15 extends inwardy into the furnace, has a bottom face 13 supported on the wall 10 and has a horizontally extending opening 17 bounded at the top by horizontally and inwardly disposed extension 18 of the cover or facing 11, at the ends by vertical faces 19, by a vertical face 20.

A central slot 21 and side slots 22 spaced horizontally from the slot 21 are provided for the reception of fuel delivery pipes, as pointed out below.

Horizontal holding arms 23 extend inwardly, from the cover or facing 11 on the sides of the slots 21 and 22 to retain the blocks 15 in place.

The opening 17 is closed at the front by an air register 25 which has a mounting strip 26, secured to the front wall cover 11 by bolts 27.

The air register 25 includes a register plate 28, pivotally connected to the mounting strip 26 by hinges 30. Turn buttons or wing nuts 31, rotatably carried on bolts 32 engaging the front cover or facing 11, releasably retain the register plate 28 in position but permit upon turning to a release position upward swinging of the plate 28 about the axes of the hinges 30.

The register plate 28 has a plurality of air admission openings 34 therealong with a pair of angularly disposed edges 35 to permit of regulation of the air induced therethrough.

The register plate 28 has a movable plate 36 carried thereon by straps 37 and with one or more actuating handles 38 which can also serve as limit stops by engagement with the straps 37 for limiting the horizontal sliding movement of the plate 36.

The movable plate 36 has a plurality of rectangular air admission openings 39 which by sliding movement of the plate 36 with respect to the register plate 28 can position the openings 39 with respect to openings 34, over the range of from fully open, as illustrated in FIG.

1, to fully closed, and with intermediate adjustment as desired including close air admission adjustment by positioning of the closing edge of an opening 39 with respect to the angularly disposed edges 35.

The upper burner block 16 has a plurality of openings at each end of predetermined diameter and with a lower downwardly flaring frustoconical opening 40 communicating with the space 17 and a connected upper upwardly flaring frustoconical opening 41, the opening 41 having a height a plurality of times that of the opening 40.

The upper burner block 16 has a central opening 42 bounded at its ends by curved faces 40*a* and 41*a*, similar to horizontally separated half portions of the openings 40 and 41 and with flat faces 40*b* and 41*b* interposed therebetween. The central opening 42 along the wall 10 is about twice the corresponding dimension of the openings 40 and 41.

A plurality of gas supply pipes 45 are provided, connected to a common source of combustible gas and have gas feed pipes 46 detachably connected thereto by connectors 47.

Each of the gas feed pipes 46 extends through an opening 48 in the register plate 28 which permits swinging movement of the register plate 28 if desired. The gas feed pipes 46, interiorly of the register plate 28 extend inwardly through the side slots 22 then upwardly and to a manifold 50 which is closed at both ends and is preferably supported on legs 51. The manifolds 50 each has a gas burner support pipe 52 extending vertically upwardly therefrom coaxial with the openings 40 and 41 and an air inspirator 55 with a gas burner 53 on the upper end thereof, and above the lower margin of the openings 41. The manifolds 50, also, have gas burner support pipes 52*a* extending upwardly therefrom in the central opening 42 with burners 53*a* spaced from the curved wall portions 41*a* approximately the same distance as the burners 53 are spaced from the faces of the openings 41.

The central opening 42 at the center thereof has an oil burner nozzle 55 of an oil burner assembly 56 disposed therein with spaced concentric pipes for oil and steam delivery to the nozzle and discharge of oil in spray form by the nozzle in a flat diverging or fan shape for combustion. The oil burner assembly 56 is detachably connected to a manifold 58 and held in assembled relation by a pivoted yoke 59 which carries a clamping screw 60. The manifold 58 has an oil supply pipe 61 connected thereto for delivery of oil to the nozzle 55 and has a steam supply pipe 62 connected thereto for the delivery of steam to the nozzle 55 for atomizing the oil in a well known manner.

The mode of operation will now be pointed out.

The furnace is operated on negative pressure.

If operation on gas alone is desired combustible gas delivered from the gas supply pipes 45 is supplied by the gas feed pipes 49 to the manifolds 50 and therefrom through the support pipes 52 for discharge with air induced at the inspirator 55 through the gas burner nozzles 53 and 53*a*. The discharge of gas and air under pressure induces air through the venturi provided by the aligned openings 40 and 41 from the space 17 in the lower burner block 15 as determined by the setting of the air register 25. The induced air at the nozzles 53 and 53*a* comes into intimate contact with the issuing gas.

The flames attendant upon the burning of gas from the nozzles or burner tips 53 and 53*a* are confined within the openings 41 and 42 extend from just above the upper ends of those openings and upwardly along the face 12. The heat from those flames as well as that transferred directly to the wall 10 from the burner block 16 is effective for heating the wall 10. The movement of the flame upwardly along the wall 10 has a Coanda effect and a scrubbing action along the wall 10.

An effective and more uniform heating action than heretofore is available for the wall 10 with stability of combustion enhanced by the confining action of the openings 41 and 42 in the burner block 16.

If operation on oil alone is desired, oil and steam supplied through the supply pipes 61 and 62 are delivered to the oil burner assembly 56 and to the oil burner nozzle 55 for atomization of the oil and delivery in spray form and in fan shape. Air is induced through the venturi provided by the central opening 42 from the space 17 in the lower burner block 15 as determined by the setting of the air register 25.

The oil flame is guided and directed upwardly along the face 12 of the wall 10 to heat the wall 10.

If only a limited supply of either fuel is available at a particular time, or if maximum heating effect is desired both gase and oil may be supplied for combined or tandem operation.

It will be noted that the gas feed pipes 46 are detachably connected to the supply pipes 45 and by reason of the positioning of the pipes 46 in the openings 22 and the gas manifolds 50 in the space 17 in the burner block 15 and the location of the burners 53 and 53*a* in the openings 41 and 42 in the upper burner block 15 the entire gas combustion structure can be readily removed for servicing, if desired, without disturbing the oil burning structure.

It will also be noted that the pivoted yoke 59 permits of separation of the oil burner assembly, including the burner nozzle 55, and removal for servicing, if desired, without disturbing the gas burning structure.

I claim:

1. Combustion apparatus for heating an exposed inner face of an upwardly extending wall of a furnace comprising support means associated with said wall having an opening communicating with the exterior of said wall, register members or controlling the introduction of air into said opening, said support means having a burner block portion with a plurality of spaced air delivery openings directed upwardly along said wall, certain of said openings being frustoconical and flaring towards their outlets, one of said openings being elongated and flaring toward its outlet, an oil burner assembly having an oil burner nozzle disposed within said elongated opening for delivery of atomized oil for combustion upwardly within said elongated opening, and a plurality of gas burners each disposed within one of said openings.

2. Combustion apparatus as defined in claim 1 in which gas manifolds are provided within said support means to which said gas burners are connected for gas delivery to said burners.

3. Combustion apparatus as defined in claim 1 in which said oil burner nozzle is centrally disposed within said elongated opening.

4. Combustion apparatus as defined in claim 3 in which gas burner nozzles are provided in said elongated opening on either side of said oil burner nozzle.

5. Combustion apparatus as defined in claim 1 in which said register members are shiftable for access to said opening in said support means.

6. Combustion apparatus as defined in claim 1 in which said register members are pivotally mounted on said support means for access to said opening in said support means.

7. Combustion apparatus as defined in claim 1 in which said support means comprises a burner block assembly, said burner block assembly has a lower burner block portion communicating with said opening, said burner block assembly has an upper burner block portion with said air delivery openings communicating with said lower burner block opening and directed upwardly along said wall.

8. Combustion apparatus as defined in claim 7 in which gas manifolds are provided within said lower burner block opening to which said gas burners are connected for gas delivery to said burners.

9. Combustion apparatus as defined in claim 7 in which said register members are pivotally mounted on the exterior of said wall for access to said lower burner block opening.

10. Combustion apparatus as defined in claim 7 in which said gas burners are carried on manifold means detachably mounted in said burner blocks.

11. Combustion apparatus as defined in claim 7 in which said oil burner is detachably mounted in said burner blocks.

* * * * *

UNITED STATES PATENT OFFICE

CERTIFICATE OF CORRECTION

Patent No. 4,009,989 Dated March 1, 1977

Inventor(s) Gordon M. Bitterlich

It is certified that error appears in the above-identified patent and that said Letters Patent are hereby corrected as shown below:

Column 4

Line 47, after "members" "or" should be - for -

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*